US008475082B2

(12) United States Patent
Fagan

(10) Patent No.: US 8,475,082 B2
(45) Date of Patent: Jul. 2, 2013

(54) SPRING LOADED J BAR T HANDLE

(75) Inventor: Ronald Lemuel Fagan, Cumming, GA (US)

(73) Assignee: Ronald Lemuel Fagan, Cumming, GA (US)

( * ) Notice: Subject to any disclaimer, the term of this patent is extended or adjusted under 35 U.S.C. 154(b) by 0 days.

(21) Appl. No.: 13/373,691

(22) Filed: Nov. 28, 2011

(65) Prior Publication Data

US 2013/0136541 A1 May 30, 2013

(51) Int. Cl.
*E02F 5/10* (2006.01)

(52) U.S. Cl.
USPC ..... 405/182

(58) Field of Classification Search
USPC ..... 405/180–183
See application file for complete search history.

(56) References Cited

U.S. PATENT DOCUMENTS 3,523,425 A * 8/1970 Pierce, Jr. ..... 405/174

* cited by examiner

*Primary Examiner* — Tara M. Pinnock

(57) ABSTRACT

Spring loaded J-Bar T Handle was created to eliminate time and effort spent loading and unloading material in the Vibratory Plow Blade. Spring mounted J-Bar T handle increases productivity and eliminates need for wrenches and other tools such as wing nuts etc. Invention also eliminates the need of a separate cable guide device allowing material to be fed directly into the chute from larger spools of material thus eliminating kinked and severed wiring and cabling.

1 Claim, 2 Drawing Sheets

SPRING LOADED J BAR T HANDLE

CROSS-REFERENCE TO RELATED APPLICATIONS

Item Related to "Vibratory Plow Blades"

STATEMENT REGARDING FEDERALLY SPONSORED RESEARCH OR DEVELOPMENT

"Not Applicable"

BACKGROUND OF THE INVENTION

Vibratory Plow Blades are devices used in laying and burying pipe, cable and wiring. Pipe, Cable and wiring can either be pulled through the cut of the plow blade or distributed through a chute. Within the Chute which holds the material it includes a device known as the J-Bar. The J-Bar holds the material in the chute for distribution. The J-Bar is connected to the plow blade with a nut and bolt. Typical problems with nut and bolt installation are eventual wear and tear as well as loss of nuts and bolts. This invention redesigns the loading and unloading of material within the vibratory plow blade. The design is a spring loaded J-Bar T Handle with a quick release to allow for fast loading time of material also eliminating equipment failure or loss due to nature of vibrations.

BRIEF SUMMARY OF THE INVENTION

Invention was created to eliminate time and effort spent loading and unloading material in the Vibratory Plow Blade. Spring mounted J-Bar T Handle increases productivity and eliminates need for wrenches and other tools such as wing nuts etc. Invention also eliminates the need of a separate cable guide device allowing material to be fed directly into the chute from larger spools of material thus eliminating kinked and severed wiring and cabling.

DETAILED DESCRIPTION OF THE INVENTION

Figure 1:
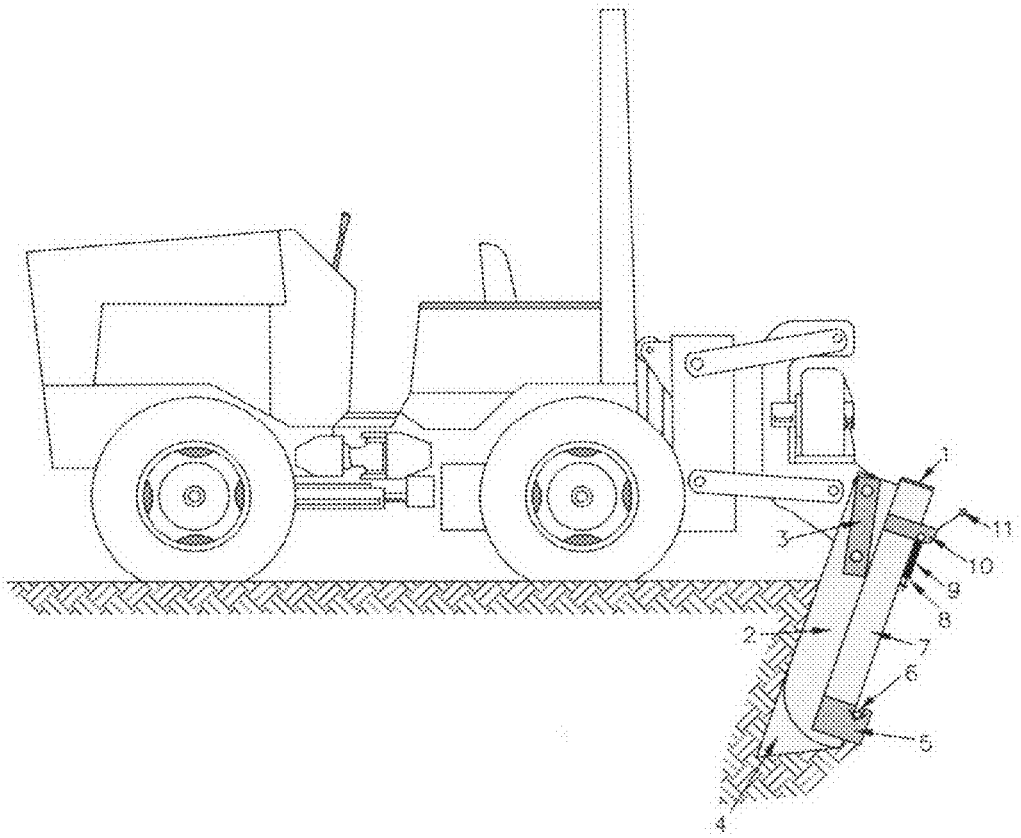
FIG. 1 is a full view of tractor with of Vibratory Plow Blade
Figure 2:
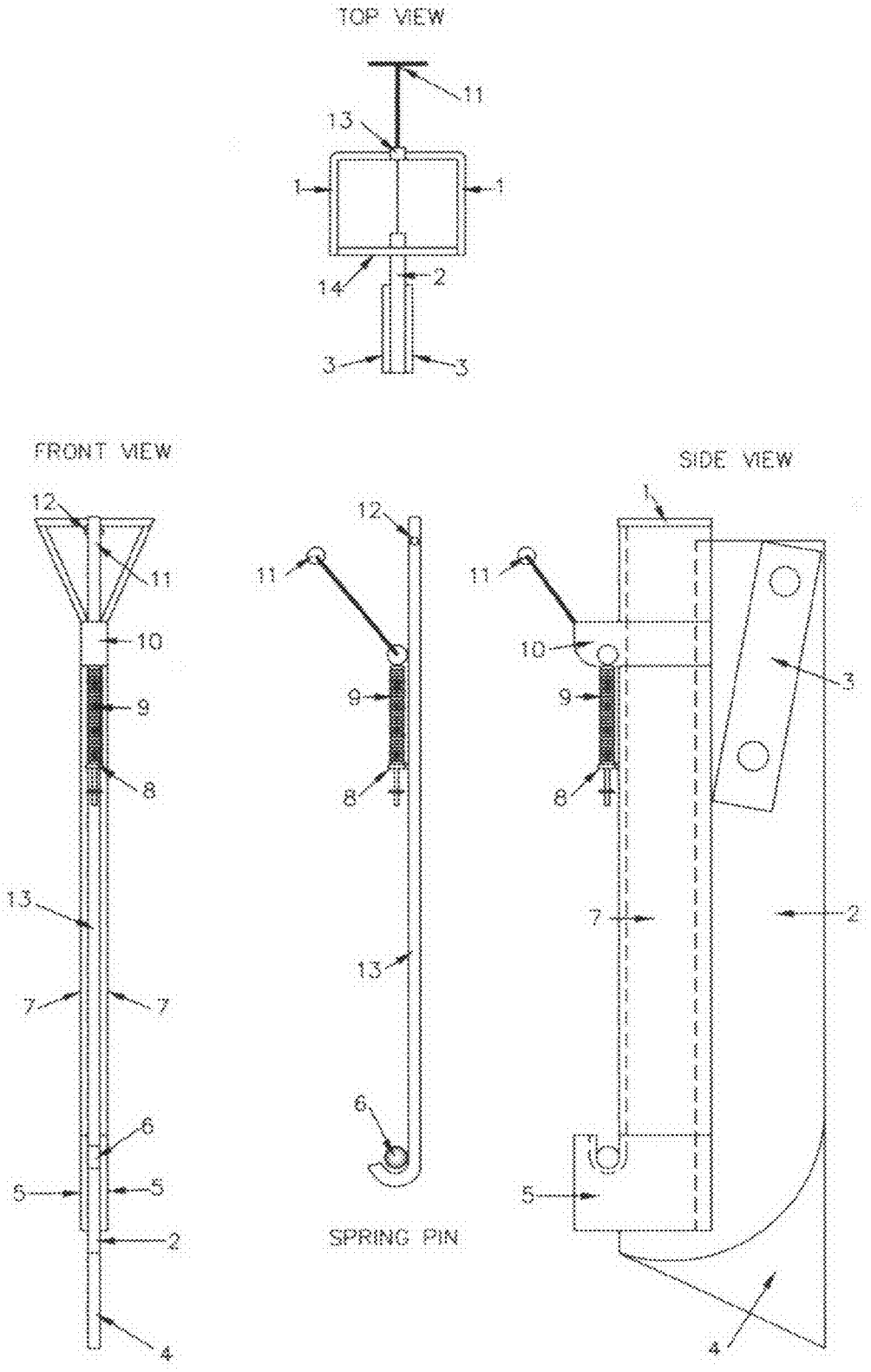
FIG. 2 is Top, Front and Side view of J Bar T Handle

Vibratory Plow Blades were introduced many years ago and little has changed until now. This invention has changed the Plow Blade for the better, making it less costly by changing and enhancing the operation. The blades cutting edges are made from harden steel material making it last longer and easier to rebuild (FIG. 2 Side view). This invention also eliminates old technology of nuts and bolts to secure the J-Bar to the blade with the new spring loaded J Bar T Handle (FIG. 2 #13). This invention also eliminates a standalone cable guide where wire/cable often work their way out of the guide increasing potential for kinking, scuffing and severing materials. This is unacceptable in the cable and wiring industry. Our cable guide is a rectangular opening (FIG. 2 #1) fabricated out of ½ inch Cold Roll Steel (CRS) into the top of the chute (FIG. 2 #1). (FIG. 2 #2) is the main body of the blade itself, designed to be one piece which equates to a more cost effective solution. (FIG. 2 #3) is the spacer with mount holes for mounting to device to tractor. (FIG. 2 #4) is cutting edge of the blade, made out of hardened steel for ease in rebuilding/refurbishing. (FIG. 2 #5) is the bottom part of the chute, made in two parts for easy replacement when rebuilding/refurbishing. (FIG. 2 #6) is the J Bar PIN, which holds the J Bar in place. (FIG. 2 #7) is the upper part of the chute. (FIG. 2 #8) is the spring collar. (FIG. 2 #9) is the actual spring designed for spring load J Bar. (FIG. 2 #10) is the locking arm which locks the J Bar in place. (FIG. 2 #11) is the "T" Handle for our device. (FIG. 2 #12) is a spring pin designed as a precaution to keep J Bar from disengaging. (FIG. 2 #13) is the J Bar. (FIG. 2 #14) is the back support for the loading chute.

I claim:

1. A device for burying a flexible elongate object, the plow comprising:

A plow blade including a structural frame for attachment to a tractor, wherein the plow blade has a cutting edge for creating a trench;

A chute connected with the plow blade, wherein the chute has an upper part and a lower part;

A locking pin attached to the upper part of the chute;

A j bar for holding the flexible elongate object adjacent the plow blade;

A locking arm for interlocking the j bar to the plow blade; and

A spring loaded handle for allowing selective engagement and disengagement of the j bar with the plow blade.

* * * * *